US011612019B2

(12) United States Patent
Kang

(10) Patent No.: US 11,612,019 B2
(45) Date of Patent: Mar. 21, 2023

(54) AIR HEATER

(71) Applicant: Hong Ku Kang, Seoul (KR)

(72) Inventor: Hong Ku Kang, Seoul (KR)

( * ) Notice: Subject to any disclaimer, the term of this patent is extended or adjusted under 35 U.S.C. 154(b) by 0 days.

(21) Appl. No.: 16/955,768

(22) PCT Filed: Oct. 11, 2019

(86) PCT No.: PCT/KR2019/013348
§ 371 (c)(1),
(2) Date: Jun. 18, 2020

(87) PCT Pub. No.: WO2020/091260
PCT Pub. Date: May 7, 2020

(65) Prior Publication Data

US 2021/0251048 A1 Aug. 12, 2021

(30) Foreign Application Priority Data

Oct. 30, 2018 (KR) ..... 10-2018-0131078

(51) Int. Cl.
*H05B 3/44* (2006.01)

(52) U.S. Cl.
CPC ..... *H05B 3/44* (2013.01); *H05B 2203/022* (2013.01)

(58) Field of Classification Search
CPC ..... H05B 3/44; B29C 65/10
See application file for complete search history.

(56) References Cited

U.S. PATENT DOCUMENTS

2018/0228216 A1 8/2018 Saygili

FOREIGN PATENT DOCUMENTS

| | | | | |
|---|---|---|---|---|
| JP | S60-019893 | U | | 2/1985 |
| JP | S60-019895 | U | | 2/1985 |
| JP | H04299259 | A | | 10/1992 |
| JP | H11144849 | A | | 5/1999 |
| JP | 3676686 | B2 | * | 7/2005 |
| JP | 2010-159898 | A1 | | 7/2010 |
| JP | 2013-126844 | A1 | | 6/2013 |
| JP | 2014229602 | A | | 12/2014 |
| KR | 10-2001-0020070 | A | | 3/2001 |
| KR | 10-2007-0044964 | A | | 5/2007 |
| KR | 10-2008-0023445 | A | | 3/2008 |
| KR | 10-2008-0023446 | A | | 3/2008 |
| KR | 20-2012-0002039 | U | | 3/2012 |
| KR | 10-2017-0014964 | A | | 2/2017 |
| KR | 10-2018-0044879 | A | | 5/2018 |

* cited by examiner

*Primary Examiner* — Jean F Duverne
(74) *Attorney, Agent, or Firm* — Invenstone Patent, LLC

(57) ABSTRACT

The present disclosure provides an air heater. The air heater comprises: a direct heat generating portion configured to be heated by an electric current supplied from outside; an indirect heat generating portion configured to be heated by conductive heat, which is supplied by physical contact with the heated direct heat generating portion, and configured to heat air coming in through an inlet opening formed on one side while the air is passing through an outlet opening formed on the other side; and a housing made of an insulating material that provides a space where the direct heat generating portion and the indirect heat generating portion are placed, and that comprises an air inlet on one side through which the air is drawn in from outside and an air vent on the other side through which the air is released.

11 Claims, 7 Drawing Sheets

200

500

700

AIR HEATER

CROSS-REFERENCE TO RELATED APPLICATIONS

This application is a national stage of International Application No. PCT/KR2019/013348, filed Oct. 11, 2019, which claims the benefit of priority to Korean Application(s) No. 10-2018-0131078, filed Oct. 30, 2018 in the Korean Intellectual Property Office, the disclosures of which are incorporated herein by reference.

BACKGROUND OF THE INVENTION

Field of the Invention

The present disclosure relates to an air heater and, more particularly, to an air heater that causes no impurities.

Related Art

Air heaters, which heat up a heating target by blowing hot air, are used in various fields. Conventional air heaters heat the air by passing air through a glass tube in which a spiral-wound heating wire is inserted.

As shown in FIG. 1, a prior unexamined utility model No. 20-2012-0002039 discloses an air heater that has a quartz glass tube 140 for insulation inserted into the surface of a stainless housing case 130, and that, when air is drawn into an air inlet opening 131, heats the air as it passes through a rectangular spiral heating wire 120 attached to a spiral-shaped, high-temperature bobbin 110.

However, heating wires, such as nichrome wires, used for heating may have particles that break off and get mixed with the air due to the nature of the metal. Thus, conventional air heaters have problems such as a decrease in yield due to the incorporation of impurities when applied to semiconductors, LEDs, etc. which require a high level of purity.

Therefore, this technical field is creating a need for air heaters that cause no impurities.

PRIOR ART DOCUMENTS

Patent Documents

Patent Document 1: Unexamined Utility Model No. 20-2012-0002039

SUMMARY OF THE INVENTION

The present disclosure provides an air heater that allows no impurities to get into a heating target and can efficiently heat the air.

According to an aspect of the present disclosure, an air heater is provided. The air heater comprises: a direct heat generating portion configured to be heated by an electric current supplied from outside; an indirect heat generating portion configured to be heated by conductive heat, which is supplied by physical contact with the heated direct heat generating portion, and configured to heat air coming in through an inlet opening formed on one side while the air is passing through an outlet opening formed on the other side; and a housing made of an insulating material that provides a space where the direct heat generating portion and the indirect heat generating portion are placed, and that comprises an air inlet on one side through which the air is drawn in from outside and an air vent on the other side through which the air is released. According to another aspect of the present disclosure, the air heater may further comprise a frame that provides support between the housing and the indirect heat generating portion so that the housing and the indirect heat generating portion are fixed a certain distance from each other.

According to another aspect of the present disclosure, the air heater may further comprise a lead portion that supplies electric power to the direct heat generating portion.

According to another aspect of the present disclosure, the direct heat generating portion may be embedded inside the indirect heat generating portion.

According to another aspect of the present disclosure, the direct heat generating portion may be placed on the outside of the indirect heat generating portion, and the air may pass through a space formed on the inside of the indirect heat generating portion.

According to another aspect of the present disclosure, the air heater may further comprise a packing portion for preventing air from getting in between the housing and the indirect heat generating portion.

According to another aspect of the present disclosure, the direct heat generating portion may be placed on the inside of the indirect heat generating portion, and the air may pass between the housing and the outside of the indirect heat generating portion.

According to another aspect of the present disclosure, the air heater may further comprise a packing portion for preventing air from getting inside the indirect heat generating portion.

According to another aspect of the present disclosure, the housing may be made of quartz.

According to another aspect of the present disclosure, the indirect heat generating portion may be made of a non-metal material.

According to another aspect of the present disclosure, the indirect heat generating portion may be made of ceramic.

According to another aspect of the present disclosure, the direct heat generating portion may be made of either nichrome or tungsten.

According to another aspect of the present disclosure, the housing and the indirect heat generating portion may have a cylindrical structure According to the present disclosure, there is provided an air heater that allows no impurities to get into a heating target because it causes no particles.

DESCRIPTION OF EXEMPLARY EMBODIMENTS

Figure 1:
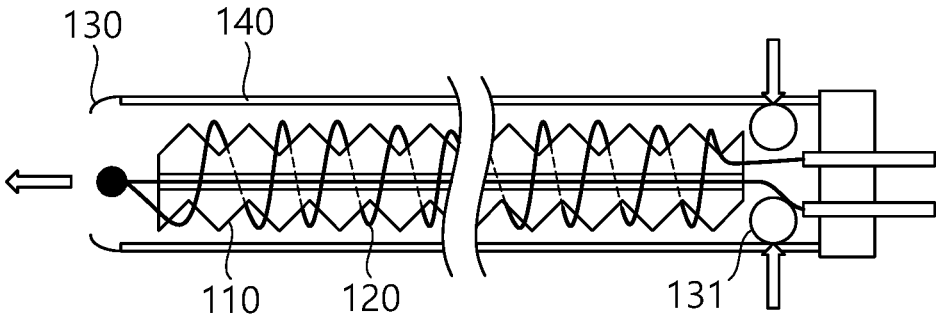
FIG. 1 shows an example of an air heater structure according to the conventional art.

Hereinafter, exemplary embodiments of the present disclosure will be described in detail with reference to the accompanying drawings so that those skilled in the art can easily carry out the present disclosure. The present disclosure may, however, be embodied in many different forms and should not be construed as limited to the embodiments set forth herein. Also, in order to clearly illustrate the present disclosure in the drawings, portions not related to the present disclosure are omitted, and the same or similar reference numerals denote the same or similar components.

The objects and effects of the present disclosure may be naturally understood or become apparent from the following description, and the objects and effects of the present disclosure are not limited only by the following description.

The objects, features and advantages of the present disclosure will become more apparent from the following detailed description. In describing the present disclosure, when it is determined that the detailed description of the known technology related to the present disclosure may unnecessarily obscure the gist of the present disclosure, the detailed description thereof will be omitted.

Figure 2:
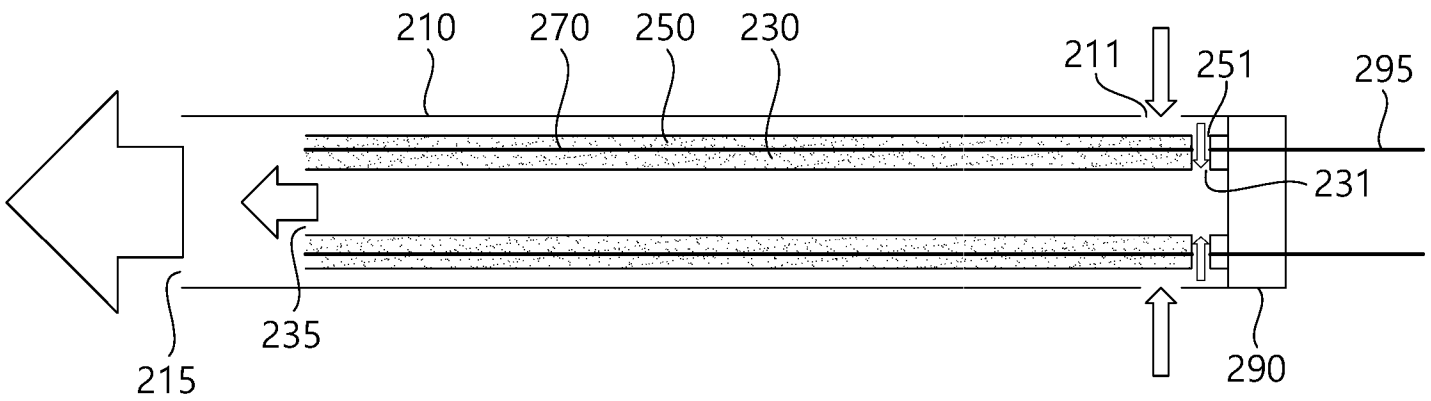
FIG. 2 shows a plan view of an air heater according to an exemplary embodiment of the present disclosure.
Figure 3:
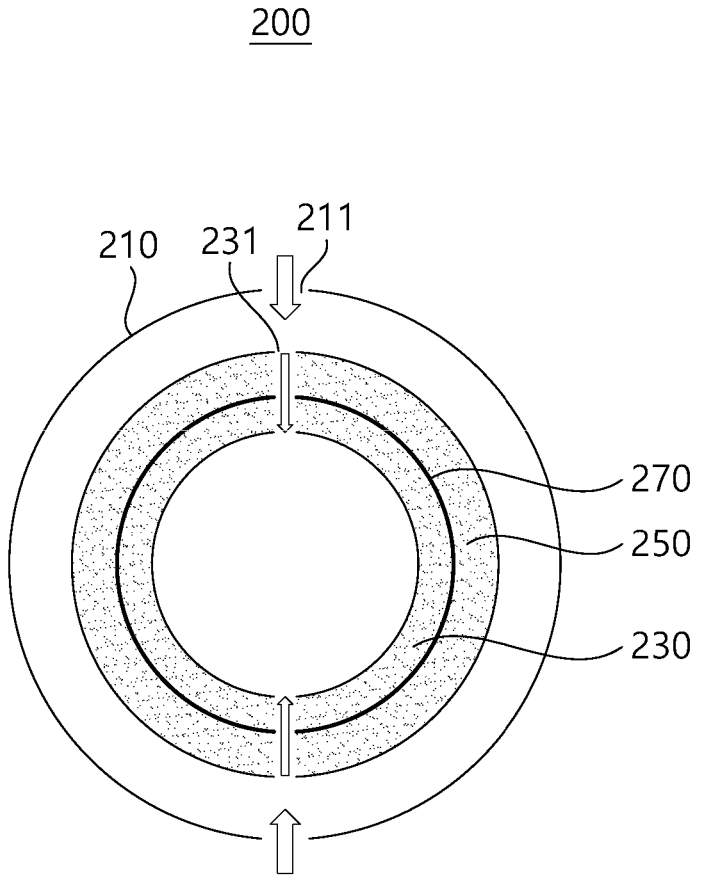
FIG. 3 illustrates a cross-sectional view of the air heater of FIG. 2 according to the exemplary embodiment of the present disclosure.

FIGS. 2 and 3 show an air heater 200 according to an exemplary embodiment of the present invention. FIG. 2 illustrates a plan view of the air heater 200, and FIG. 3 illustrates a cross-sectional view of the air heater 200.

Referring to FIGS. 2 and 3, the air heater 200 comprises a housing 210, a first indirect heat generating portion 230, a second indirect heat generating portion 250, a direct heat generating portion 270, a frame 290, and a lead portion 295.

The housing 210 provides a space in it where the first and second indirect heat generating portions 230 and 250 and the direct heat generating portion 270 can be placed, with an air inlet 211 on one side through which air is drawn in from outside and an air vent 215 on the other side through which the air is released. The housing 210 may be made of an insulating material, for example, a quartz material which does not deform under heat and has an insulation effect. Although the housing 210 in FIGS. 2 and 3 is cylindrically shaped, it also may come in various shapes such as a triangular prism, rectangular prism, etc. Meanwhile, heated air is released to a heating target by means of the housing 210, and the housing 210 is preferably made longer than the first and second indirect heat generating portions 230 and 250.

Figure 4:
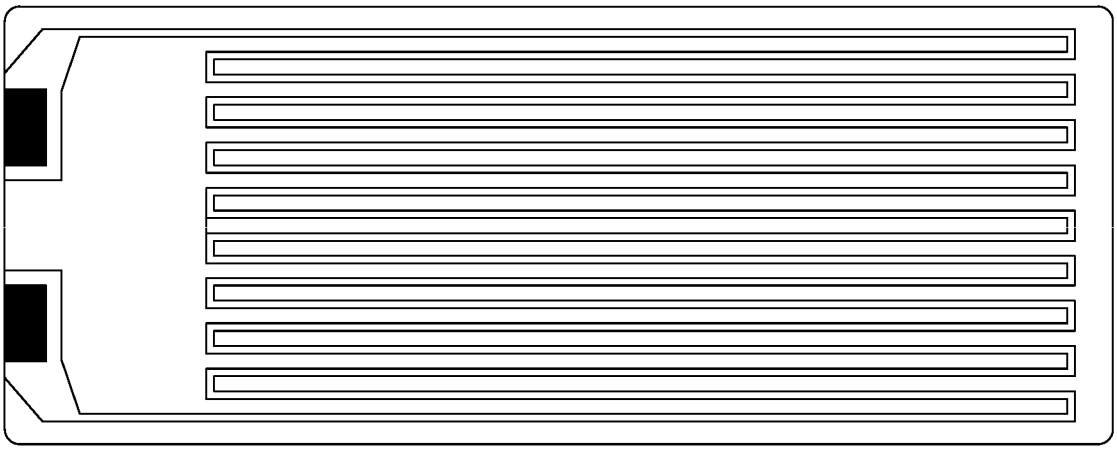
FIG. 4 shows a pattern structure of a direct heat generating portion according to an exemplary embodiment of the present disclosure.

The first and second indirect heat generating portions 230 and 250 may be placed inside the housing 210 and made into the shape of a hollow rod. First and second air inlet openings 231 and 251 are formed on one side of the first and second indirect heat generating portions 230 and 250 to draw air in from outside. The first and second air inlet openings 231 and 251 are positioned in the same locations as the first and second indirect heat generating portions 230 and 250. Meanwhile, an outlet opening 235 for releasing air drawn in through the first and second air inlet openings 231 and 251 is formed on the other side of the first indirect heat generating portion 230. The first and second indirect heat generating portions 230 and 250 may come in a variety of shapes such as a triangular prism, rectangular prism, cylinder, etc. Moreover, the first and second indirect heat generating portions 230 and 250 may be made of a non-metal material—preferably, a non-metal material that does not deform under high temperature and has a high thermal conductivity. In an example, a ceramic material may be used, which is obtained by baking at a high temperature of 1600° C. The direct heat generating portion 270 is configured as an electrical heating wire or electrical heating pattern which can generate heat through application of electricity. In an example, the direct heat generating portion 270 may be made of a metal material such as nichrome wire, tungsten, etc. Meanwhile, the direct heat generating portion 270 may come in a variety of shapes—for example, in the shape of an electrical heating pattern shown in FIG. 4. The direct heat generating portion 270 is placed to surround the outside of the first indirect heat generating portion 230, and then the outer ceramic portion 250 is placed to surround the outside of the direct heat generating portion 270. Thus, the direct heat generating portion 270 is embedded between the first indirect heat generating portion 230 and the second indirect heat generating portion 250. The frame 290 provides support so that the housing 210 and the second indirect heat generating portion 250 are fixed a certain distance from each other, and the lead portion 295 electrically connects a power supply source and the direct heat generating portion 270 in order to supply electric power to the direct heat generating portion 270.

According to an example of the present disclosure, air may enter from one end inside the first indirect heat generating portion 230 and be released to the other end. At this point, the air is heated to a high temperature as it comes into contact with the inside of the first indirect heat generating portion 230. Since the air is heated by the first indirect heat generating portion 230 without coming into contact with the direct heat generating portion 270, any impurities that may be produced from high-temperature metals may not get into the air. At this point, the first indirect heat generating portion 230 may be made thinner than the second indirect heat generating portion 250 in order to further enhance thermal efficiency.

In another example, air may enter from one end of a space formed between the second indirect heat generating portion 250 and the housing 210 and be released to the other end. At this point, the air is heated to a high temperature as it comes into contact with the outside of the second indirect heat generating portion 250. In this case as well, the air comes into contact only with the second indirect heat generating portion 250 and the housing 210 but not with the direct heat generating portion 270, thereby preventing any impurities that may be produced from high-temperature metals from getting into the air. At this point, the second indirect heat generating portion 250 may be made thinner than the first indirect heat generating portion 230 in order to further enhance thermal efficiency.

In yet another example, air may pass through both a space formed inside the first indirect heat generating portion 230 and the space formed between the second indirect heat generating portion 250 and the housing 210. At this point, the air is heated through the inside of the first indirect heat generating portion 230 and the outside of the second indirect heat generating portion 250, thereby further improving thermal efficiency compared to the preceding examples.

While, in this exemplary embodiment, the frame 290 is formed only in some of the space between the housing 210 and the second indirect heat generating portion 250 and only serves to provide support between the housing 210 and the second indirect heat generating portion 250, it also may be formed to block the entire space between the housing 210 and the second indirect heat generating portion 250 and serve as a stopper for preventing air movement between the housing 210 and the second indirect heat generating portion 250.

The rate at which the air is heated is determined by the amount of electric power supplied to the direct heat generating portion 270, the area of contact between the air and the first indirect heat generating portion 230 and/or second indirect heat generating portion 250, and the rate at which the air passes through the first indirect heat generating portion 230 and/or second indirect heat generating portion 250. Concretely, the temperature of the air may be therefore adjusted as necessary by the above parameters.

Figure 5:
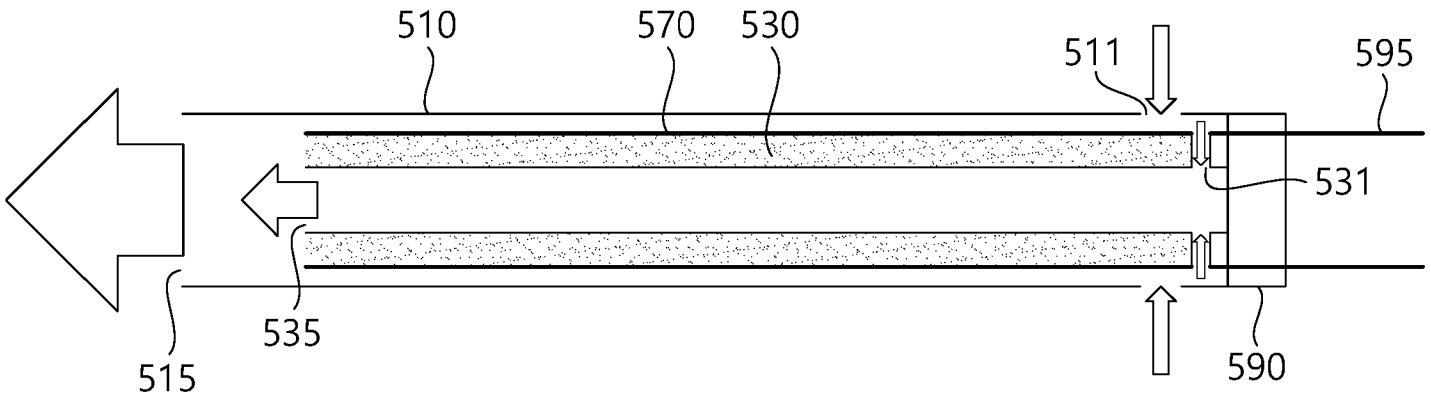
FIG. 5 shows a plan view of an air heater according to another exemplary embodiment of the present disclosure.
Figure 6:
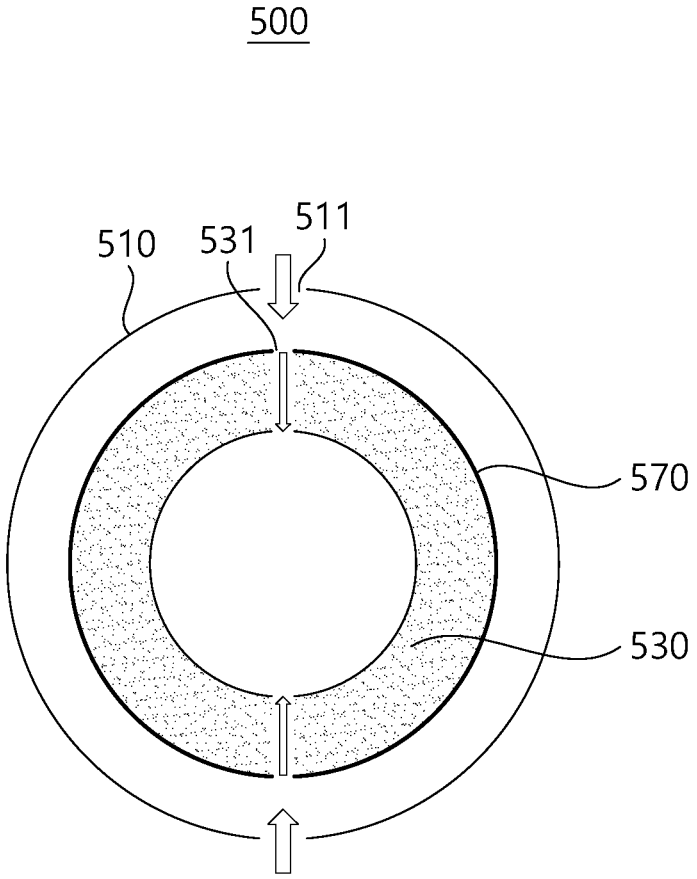
FIG. 6 illustrates a cross-sectional view of the air heater of FIG. 5 according to the exemplary embodiment of the present disclosure.

FIGS. 5 and 6 show an air heater 500 according to another exemplary embodiment of the present disclosure. FIG. 5 illustrates a plan view of the air heater 500, and FIG. 6 illustrates a cross-sectional view of the air heater 500.

Referring to FIGS. 5 and 6, the air heater 500 comprises a housing 510, an indirect heat generating portion 530, a direct heat generating portion 570, a frame 590, and a lead portion 595.

The housing 510 provides a space in it where the indirect heat generating portion 530 and the direct heat generating portion 570 can be placed, with an air inlet 511 on one side through which air is drawn in from outside and an air vent 515 on the other side through which the air is released. The housing 510 may be made of an insulating material, for example, a quartz material which does not deform under heat and has an insulation effect. Although the housing 510 in FIGS. 5 and 6 is cylindrically shaped, it also may come in various shapes such as a triangular prism, rectangular prism, etc. Meanwhile, heated air is released to a heating target by means of the housing 510, and the housing 510 is preferably made longer than the indirect heat generating portion 530.

The indirect heat generating portion 530 may be placed inside the housing 510 and made into the shape of a hollow rod. An air inlet opening 531 is formed on one side of the indirect heat generating portion 530 to draw air in from outside. Meanwhile, an outlet opening 535 for releasing air drawn in through the air inlet opening 531 is formed on the other side of the indirect heat generating portion 530. The indirect heat generating portion 530 may come in a variety of shapes such as a triangular prism, rectangular prism, cylinder, etc. Moreover, the indirect heat generating portion 530 may be made of a non-metal material—preferably, a non-metal material that does not deform under high temperature and has a high thermal conductivity. In an example, a ceramic material may be used, which is obtained by baking at a high temperature of 1600° C. The direct heat generating portion 570 is placed to surround the outside of the indirect heat generating portion 530, and is configured as an electrical heating wire or electrical heating pattern which can generate heat through application of electricity. In an example, the direct heat generating portion 570 may be made of a metal material such as nichrome wire, tungsten, etc. Meanwhile, the direct heat generating portion 570 may come in a variety of shapes—for example, in the shape of an electrical heating pattern shown in FIG. 4. The direct heat generating portion 570 is placed to surround the outside of the indirect heat generating portion 530. The frame 590 provides support so that the housing 510 and the indirect heat generating portion 530 are fixed a certain distance from each other, and the lead portion 595 electrically connects a power supply source and the direct heat generating portion 570 in order to supply electric power to the direct heat generating portion 570.

In this exemplary embodiment, air may enter from one end inside a space formed by the indirect heat generating portion 530, in order to minimize friction between the air and the direct heat generating portion 570. At this point, the air is heated to a high temperature as it comes into contact with the inner surface of the indirect heat generating portion 530. The air is heated as it passes through the inside of the indirect heat generating portion 530 without friction with the direct heat generating portion 570, and this may minimize impurities that may be produced from high-temperature metals and get into the air. Meanwhile, although not shown in the drawings, a packing portion may be further included on one end of the housing 510 to prevent air from getting in between the housing 510 and the indirect heat generating portion 530. Moreover, the frame 590 may serve as a packing portion for stopping air flow between the housing 510 and the indirect heat generating portion 530.

Figure 7:
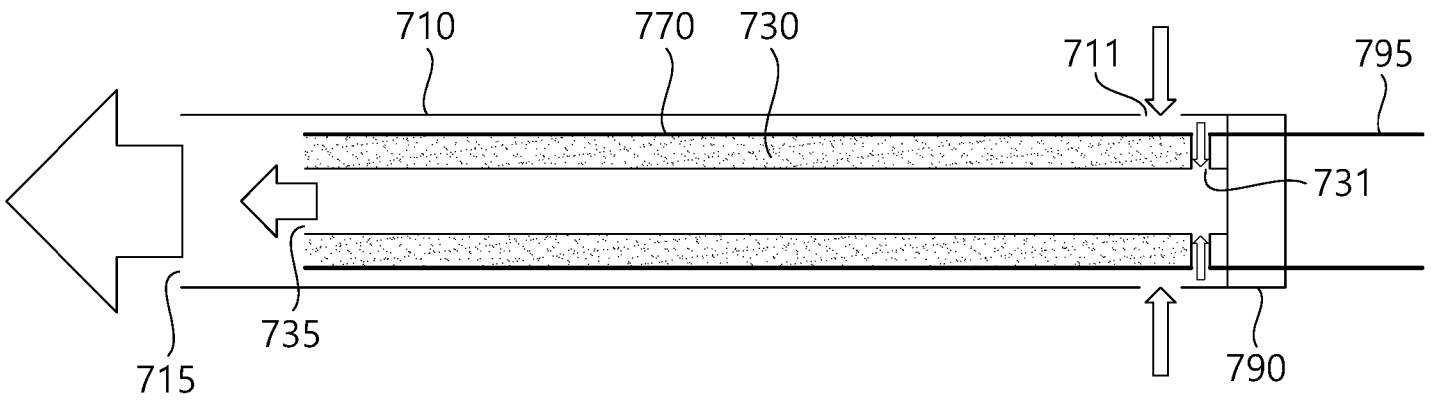
FIG. 7 shows a plan view of an air heater according to yet another exemplary embodiment of the present disclosure.
Figure 8:
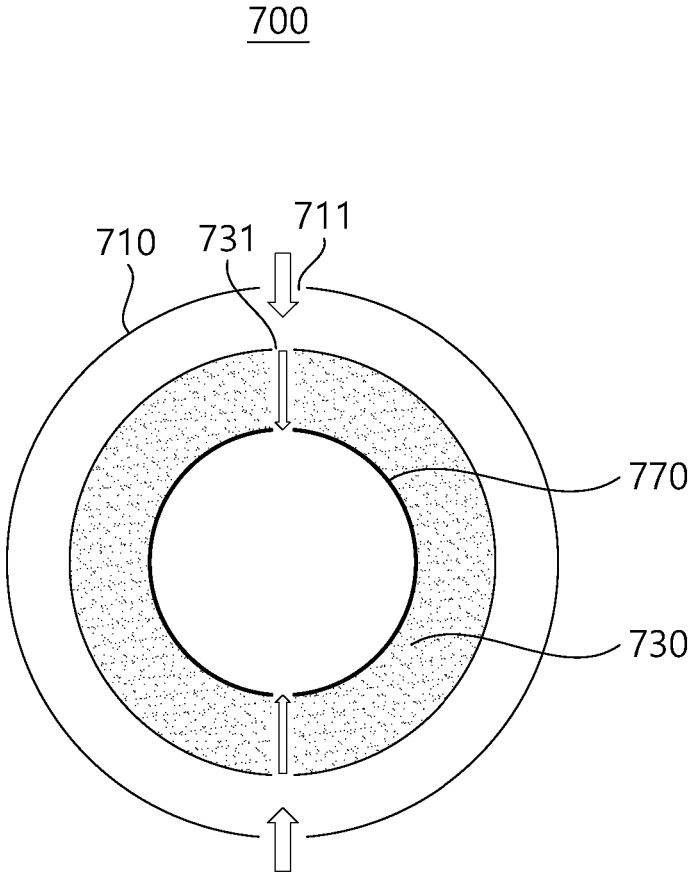
FIG. 8 illustrates a cross-sectional view of the air heater of FIG. 7 according to the exemplary embodiment of the present disclosure.

FIGS. 7 and 8 show an air heater 700 according to yet another exemplary embodiment of the present disclosure. FIG. 7 illustrates a plan view of the air heater 700, and FIG. 8 illustrates a cross-sectional view of the air heater 700.

Referring to FIGS. 7 and 8, the air heater 700 comprises a housing 710, an indirect heat generating portion 730, a direct heat generating portion 770, a frame 790, and a lead portion 795.

The housing 710 provides a space in it where the indirect heat generating portion 730 and the direct heat generating portion 770 can be placed, with an air inlet 711 on one side through which air is drawn in from outside and an air vent 715 on the other side through which the air is released. The housing 710 may be made of an insulating material, for example, a quartz material which does not deform under heat and has an insulation effect. Although the housing 710 in FIGS. 7 and 8 is cylindrically shaped, it also may come in various shapes such as a triangular prism, rectangular prism, etc. Meanwhile, heated air is released to a heating target by means of the housing 710, and the housing 710 is preferably made longer than the indirect heat generating portion 730.

The indirect heat generating portion 730 may be placed inside the housing 710 and made into the shape of a hollow rod. An air inlet opening 731 is formed on one side of the indirect heat generating portion 730 to draw air in from outside. Meanwhile, an outlet opening 735 for releasing air drawn in through the air inlet opening 731 is formed on the other side of the indirect heat generating portion 730. The indirect heat generating portion 730 may come in a variety of shapes such as a triangular prism, rectangular prism, cylinder, etc. Moreover, the indirect heat generating portion 730 may be made of a non-metal material—preferably, a non-metal material that does not deform under high temperature and has a high thermal conductivity. In an example, a ceramic material may be used, which is obtained by baking at a high temperature of 1600° C. may be used. The direct heat generating portion 770 is placed on an inner wall surface of the indirect heat generating portion 730, and is configured as an electrical heating wire or electrical heating pattern which can generate heat through application of electricity. In an example, the direct heat generating portion 770 may be made of a metal material such as nichrome wire, tungsten, etc. Meanwhile, the direct heat generating portion 770 may come in a variety of shapes—for example, in the shape of an electrical heating pattern shown in FIG. 4. The frame 790 provides support so that the housing 710 and the indirect heat generating portion 730 are fixed a certain distance from each other, and the lead portion 795 electrically connects a power supply source and the direct heat generating portion 770 in order to supply electric power to the direct heat generating portion 770.

In this exemplary embodiment, air may enter from one end of a space formed between the housing 710 and the indirect heat generating portion 730, in order to minimize friction between the air and the direct heat generating portion 770. At this point, the air is heated to a high temperature as it comes into contact with the outer surface of the indirect heat generating portion 730. The air is heated as it passes through the space between the housing 710 and the indirect heat generating portion 730 without friction with the direct heat generating portion 770, and this may minimize impurities that may be produced from high-temperature metals and get into the air. Meanwhile, although not shown in the drawings, a packing portion may be further included on one end of the indirect heat generating portion 730 to prevent air from getting inside the indirect heat generating portion 730.

While conventional air heaters have the problem that fine metal particles or the like from a heating wire may get into the air as the air is heated by direct contact with the heating wire, the present disclosure allows for heating the air without metal particles getting into the air because the heating wire is embedded between ceramic portions and the air is heated not directly by the heating wire but indirectly by the ceramic portions.

What is claimed is:

1. An air heater comprising:

a direct heat generating portion configured to be heated by an electric current supplied from outside;

an indirect heat generating portion configured to be heated by conductive heat, which is supplied by physical contact with the heated direct heat generating portion, and configured to heat air coming in through an inlet opening formed on one side while the air is passing through an outlet opening formed on the other side; and a housing made of an insulating material that provides a space where the direct heat generating portion and the indirect heat generating portion are placed, and that comprises an air inlet on one side through which the air is drawn in from outside and an air vent on the other side through which the air is released, wherein the indirect heat generating portion includes a first indirect heat generating portion and a second indirect heat generating portion, wherein the direct heat generating portion is disposed between the first indirect heat generating portion and the second indirect heat generating portion, wherein the air coming in through the inlet opening is divided into a first portion and a second portion, the first portion of the air flowing through a first space formed inside the indirect heat generating portion, the second portion of the air flowing through a second space formed between the indirect heat generating portion and the housing, and wherein the first indirect heat generating portion heats the first portion of the air, and at the same time, the second indirect heat generating portion heats the second portion of the air.

2. The air heater of claim 1, further comprising a frame that provides support between the housing and the indirect heat generating portion so that the housing and the indirect heat generating portion are fixed a certain distance from each other.

3. The air heater of claim 1, further comprising a lead portion that supplies electric power to the direct heat generating portion.

4. The air heater of claim 1, wherein the direct heat generating portion is embedded inside the indirect heat generating portion.

5. The air heater of claim 1, further comprising a packing portion for preventing air from getting in between the housing and the indirect heat generating portion.

6. The air heater of claim 1, further comprising a packing portion for preventing air from getting inside the indirect heat generating portion.

7. The air heater of claim 1, wherein the housing is made of quartz.

8. The air heater of claim 1, wherein the indirect heat generating portion is made of a non-metal material.

9. The air heater of claim 8, wherein the indirect heat generating portion is made of ceramic.

10. The air heater of claim 1, wherein the direct heat generating portion is made of either nichrome or tungsten.

11. The air heater of claim 1, wherein the housing and the indirect heat generating portion have a cylindrical structure.

* * * * *